US009084441B1

(12) United States Patent
Azer

(10) Patent No.: US 9,084,441 B1
(45) Date of Patent: Jul. 21, 2015

(54) COLLAPSIBLE COLLAR STAY

(71) Applicant: Ephriam Azer, Passaic, NJ (US)

(72) Inventor: Ephriam Azer, Passaic, NJ (US)

( * ) Notice: Subject to any disclaimer, the term of this patent is extended or adjusted under 35 U.S.C. 154(b) by 436 days.

(21) Appl. No.: 13/630,077

(22) Filed: Sep. 28, 2012

(51) Int. Cl.
*A41B 3/06* (2006.01)
*A41B 3/00* (2006.01)

(52) U.S. Cl.
CPC .. *A41B 3/06* (2013.01); *A41B 3/005* (2013.01)

(58) Field of Classification Search
CPC ..... A41B 3/00; A41B 3/06; A41B 3/08; A41D 26/16; A41D 27/06; A41D 27/16
USPC ..... 2/60, 129, 134, 255, 256, 258, 261, 2/262, 264; 292/163, 175
See application file for complete search history.

(56) References Cited

U.S. PATENT DOCUMENTS 2,545,020 A * 3/1951 Coffing ..... 2/132
2,726,400 A * 12/1955 Ruane ..... 2/132
2,799,024 A * 7/1957 Oscard ..... 2/132
4,627,421 A * 12/1986 Symbas et al. ..... 600/232
4,747,395 A * 5/1988 Brief ..... 600/210
5,000,163 A * 3/1991 Ray et al. ..... 600/233
5,967,974 A * 10/1999 Nicholas et al. ..... 600/233
6,145,407 A * 11/2000 Rottmann ..... 74/502.2
7,270,632 B2 * 9/2007 Santilli ..... 600/234
7,409,730 B2 8/2008 Boos
8,108,948 B2 2/2012 Boos
2012/0227163 A1 9/2012 Schottenstein

* cited by examiner

*Primary Examiner* — Richale Quinn
*Assistant Examiner* — Anne Kozak
(74) *Attorney, Agent, or Firm* — Michael J. Feigin, Esq.; Feigin & Associates, LLC

(57) ABSTRACT

An adjustable collar stay has two components: a) a housing, and b) a movable piece having a wider head and elongated portion, the elongated portion adapted for slidably moving within the housing. The wider head is at least one cross-section disposed perpendicular to the point of entry (portal) into the housing, preventing its entry thereto. A spring-loaded pin, situated within the housing, engages with a pit, cut into the side of the elongated region of the movable piece. By grasping the head and pushing it transverse to the direction of the housing, one dislodges the pin from a pit, and moves the movable piece with respect to the housing, in order to elongate or shorten the entire device.

12 Claims, 7 Drawing Sheets

COLLAPSIBLE COLLAR STAY

BACKGROUND OF THE DISCLOSED TECHNOLOGY

Collar stays are used in the art to keep collars of shirts, especially dress shirts, taut. Typically, a portal is sewn into the collar of the shirt, on either side, adapted for insertion of a collar stay there-in. A collar stay, for purposes of this disclosure, is defined as a rigid, elongated member adapted for insertion within a portal within a collar of a shirt. However, shirts come in different sizes, and even amongst shirts which are the same size, the size of the collar may vary. Still further, the size of the portal for insertion of a collar stay may vary. As such, one may find that collar stays are too short, too long, too wide, and/or too narrow for a portal within a collar.

What is needed in the art is a way to provide a method and mechanism for allowing collar stays to fit in any shirt. Currently, one must either hope that the collar stay will fit, and risk having it be swallowed up inside the collar, meaning that it is ineffective and hard to remove, or stick out of the end of the portal which is undesirable, especially since such stays are generally part of classier shirts and modes of dress. A stick extending from one's collar detracts greatly from a polished look. The other option is to have collar stays of many different sizes and learn, usually through trial and error, which collar stay fits within which shirt.

SUMMARY OF THE DISCLOSED TECHNOLOGY

Therefore, it is an object of the disclosed technology to provide an adjustable length collar stay.

In a further embodiment of the disclosed technology a simple to use, durable collar stay is provided, which fits a variety of shirts with different size portals for a collar stay.

In an embodiment of the disclosed technology, an adjustable collar stay has an elongated housing with a hollow, elongated interior space. This hollow and elongated interior space has a portal at a front side of the device. A movable piece, a single piece having a head and elongated portion, is slidable within the interior space of the housing. More precisely, the elongated portion of the movable piece is adapted to move by sliding within a hollow interior track of the elongated housing, and has a plurality of pits (grooves cut into a side of the elongated housing) disposed on one side thereof. The elongated portion of the movable piece and the head of the movable piece are delineated by the greater width of the head, at the point of connection, with the elongated portion which has two generally parallel sides adapted to slide within a track having two corresponding parallel sides. While the head region may also have two parallel sides, these sides are, by definition, wider than the elongated portion and do not fit within the track of the housing. Or, the head region may have sides which are not parallel; however, an end of the head region is, by definition, wider than the elongated portion of the movable piece, thereby preventing movement of the head region into the housing of the device. A spring-loaded pin is rotatably fixed at a first end to the elongated housing. At a second end, the spring-loaded pin extends into a pit of the plurality of pits.

In embodiments of the disclosed technology, but for the spring-loaded pin extending into a pit of the plurality of pits (of the movable piece), the movable piece would be freely movable into and out of (slidable) within the portal at the front side of the device. Thus, the pin prevents movement. However, with an engaged pin into a pit, the movable piece is still movable in a direction transverse to the portal which is also defined as a direction other than parallel to the track of the elongated housing. Moving the movable piece in the direction transverse to the portal causes dislodging of the second end of the spring-loaded pin from a pit of the plurality of pits. Such moving causes, the movable piece to become slidable into and out of the portal, at least partially, if not fully, such as at least until the second end of the spring-loaded pin engages with a different pit of the plurality of pits. When the second end of the spring-loaded pin engages with a new pit of the plurality of pits, the kinetic forces/movement thereof may be discernible by one holding the device and, as such, the holder knows when to stop extending or contracting the device.

The head of the movable piece may be triangular with a base thereof having a width wider than the hollow interior track, and a tip, opposite the base, having a width narrower than the hollow interior track. The 'base' refers to the 'base' of the triangle and is adjacent to the elongated portion of the movable piece. The 'width' refers to the distance from one side of the base to the other, or a distance between two points parallel to this distance.

In a method of using an adjustable collar stay of embodiments of the disclosed technology, one grasps an elongated body and head of the adjustable collar stay, such as each with a different hand. The head is pushed in a direction transverse to a length of the elongated body (the longest direction of the body is defined as the "length" while the width is defined as above and/or is perpendicular to the length). This causes a spring-loaded pin, which is rotatably connected to the elongated body, to disengage from a first pit. The first pit is one of a plurality of pits cut into a movable piece, the movable piece, in turn, forming a unitary structure with the above-mentioned head. Once the pin has been dislodged from a pit, the head may be slid (moved closer to, or further away from, the elongated body in a generally perpendicular direction to the length of the body; 'generally' being defined as within a tolerance level accepted in the art at the time of use, such as within 5 degrees or 5%, where applicable). The sliding occurs until the spring-loaded pin rotates (lodges in) a second pit of the movable piece. Then, one places the adjustable collar stay into a portal of a collar adapted to receive this, or any other, collar stay.

The movable piece is movable in a direction transverse to the longest side of the elongated housing, irrespective of whether the end of the spring-loaded pin is in the first pit or the second pit, in an embodiment of the above-described method. The step of moving may be carried out until force associated with the spring-loaded pin entering into the second pit is felt. Still further, the first and second pits may not be next to each other, but may be spaced apart with pits in-between bypassed.

The head of the movable piece may be triangular with a base thereof having a greater width than the width of a hollow interior of the elongated body. A tip of the head, opposite the base, may have a width narrower than the width of the hollow interior of the elongated body.

In yet another embodiment, an adjustable length device may have a housing with a hollow elongated interior, a pin rotatably fixed to a protrusion extending into the hollow elongated interior, and a slidable member adapted to slide within the hollow elongated interior, in a manner such that the slidable member has a side parallel to at least one corresponding side of the hollow elongated interior in a resting position. A plurality of pits cut into the slidable member, each adapted to engage an end of the pin opposite the (rotatably) fixed side of the pin, is also part of the device. In an embodiment of the disclosed technology, in the resting position, if the pin is aligned with a pit of the plurality of pits, the pin rests within the pit. Further, when the slidable member is offset by a minimum number of degrees from parallel to at least one corresponding side of the hollow elongated interior of the housing (such as offset by 1, 2, 3, 4, 5, 6, 7, 8, 9, 10, or 15 degrees), the pin is prevented from engaging with any pits of the plurality of pits. When a person feels the pin passing over a pit (which is detectable, in embodiments of the disclosed technology), the user may decide to stop sliding the slidable member with respect to the housing, letting the pin rest in the detected pit.

DETAILED DESCRIPTION OF EMBODIMENTS OF THE DISCLOSED TECHNOLOGY

The present technology is directed to an adjustable length collar stay.

In an embodiment of the disclosed technology, an adjustable collar stay has an elongated housing with a hollow elongated interior space. This hollow and elongated interior space has a portal at a front side of the device. A movable piece, a single piece having a head and elongated portion, is slidable within the interior space of the housing. More precisely, the elongated portion of the movable piece is adapted to slidably move within a hollow interior track of the elongated housing, and has a plurality of pits disposed on one side thereof. The elongated portion of the movable piece and the head of the movable piece are delineated by the greater width of the head, at the point of connection, with the elongated portion, which has two generally parallel sides adapted to slide within a track having two corresponding parallel sides. While the head region may also have two parallel sides, these sides are, by definition, wider than the elongated portion and do not fit within the track of the housing. Or, the head region may have sides which are not parallel; however, an end of the head region is, by definition, wider than the elongated portion of the movable piece, thereby preventing movement of the head region into the housing of the device. A spring-loaded pin is rotatably fixed at a first end to the elongated housing. At a second end, the spring-loaded pin extends into a pit of the plurality of pits.

Embodiments of the disclosed technology will become clearer in view of the following description of the figures.

Figure 1:
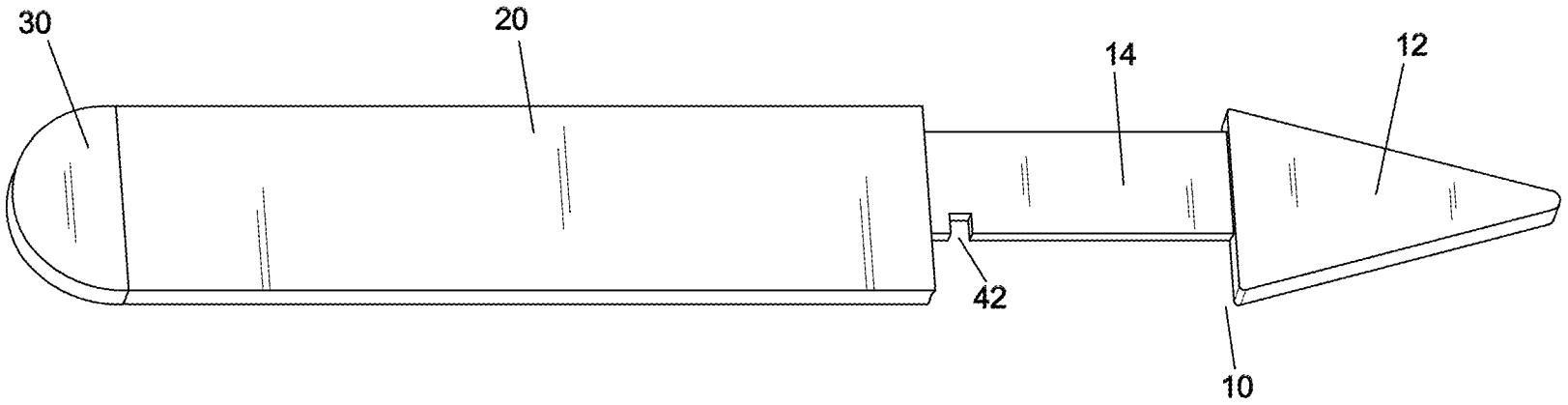
FIG. 1 shows a top perspective view of an adjustable collar stay of the disclosed technology, in an extended configuration.

FIG. 1 shows a top perspective view of an adjustable collar stay of the disclosed technology, in an extended configuration. A front of the device is defined, for purposes of this disclosure, by the head 12 of the movable piece 10, the movable piece being defined (for purposes of this disclosure) as the piece which moves, relative to the housing 20. The housing 20 comprises therein a spring-loaded pin, and the movable piece 10 comprises a head section 12, wider than an internal track of the housing, and elongated portion 14 with a plurality of pitted grooves. As shown in FIG. 1, the back end piece 30, housing 20, and movable piece 10 are viewable. Further, on the movable piece, one can see the head region 12, elongated portion 14, and a first notch or groove 42, which is defined as a section of the elongated portion 14, and which is cut out of an otherwise planar side of the elongated portion.

Figure 2:
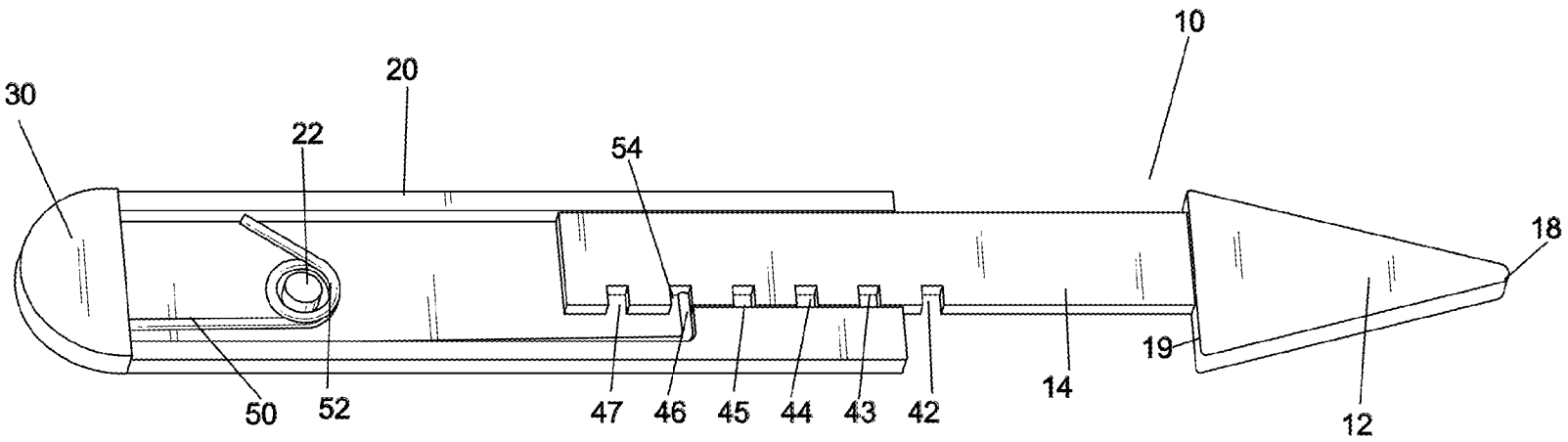
FIG. 2 shows the top perspective view of the adjustable collar stay in an extended configuration of FIG. 1, with the cover removed.

FIG. 2 shows the top perspective view of the adjustable collar stay in an extended configuration of FIG. 1, with the cover removed. Here, one can see that inside the housing 20 is a fixed protrusion of flange 22, which may form a unitary structure with the housing 20, which serves to fix the pin 50 in place. As such, the pin 50 is rotatably fixed to the housing, meaning that the position of the pin is fixed to an imaginary or real point relative to the housing, while the rest of the pin is rotatable about this point. The pin 50 has an attached first end 52, and a rotating second end 54, the rotating second end 54 being adapted to latch into any one of the pits. Here, six pits are shown and numbered 42, 43, 44, 45, 46, and 47. To latch into, or engage with, a pit is defined as abutting the elongated portion 14 of the movable piece 10 based on frictional engagement between side walls of a pit, such as any one of pits 42 through 47.

Referring now to the head 12, in the embodiment shown in the figures, the head is triangular, and is actually, an isosceles triangle. The triangle has a base 19 and tip 18. The base, for purposes of this disclosure, is the side which is unequal to the other two sides. Here, the tip 18 of the triangular head is narrower than the base 19. In other embodiments, the base and tip of the head may be of any size relative to one another, so long as the base is wider than a portal of entry into the housing adapted to receive the elongated portion 14.

The base 19, whether the head is a triangle or other shaped head 12, is further defined as a side adjacent to the elongated portion, and differentiated from the elongated portion in that the width of the side adjacent to the elongated portion is greater than that of the elongated portion and, further, greater than that of a track within the housing 20 and portal of entry there-to which the elongated portion 14 enters through. The portal (unnumbered) is the sole point of entry into the housing, which the elongated portion 14 of the movable piece 10 fits into, and is further slidably movable in and out of the housing via the portal, but for the pin's rotating second end 54 engaging with a pit of the elongated portion 14.

Figure 3:
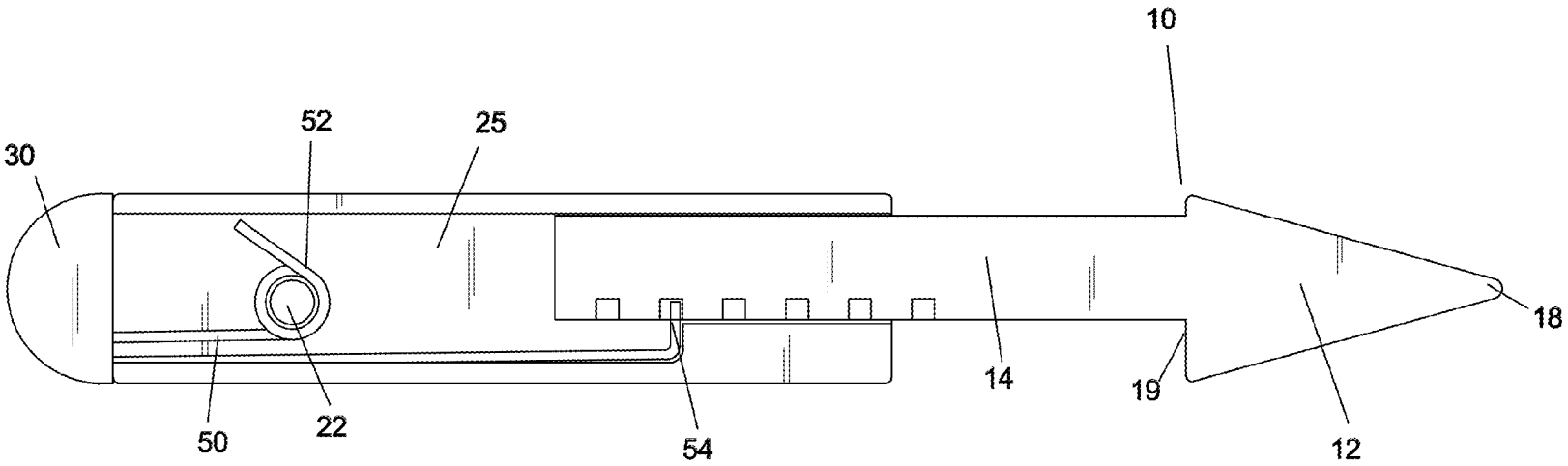
FIG. 3 shows a top plan view of the extended configuration collar stay of FIGS. 2.

FIG. 3 shows a top plan view of the extended configuration collar stay of FIG. 2. In this figure, the internal track area 25 of the housing 20 is more clearly seen. The sides of the track are parallel, in embodiments of the disclosed technology, to the length of the elongated portion 14 of the movable piece 10 (except for, possibly, the pits of the elongated portion 14 but for purposes of this disclosure, this is still considered "parallel to").

Figure 4:
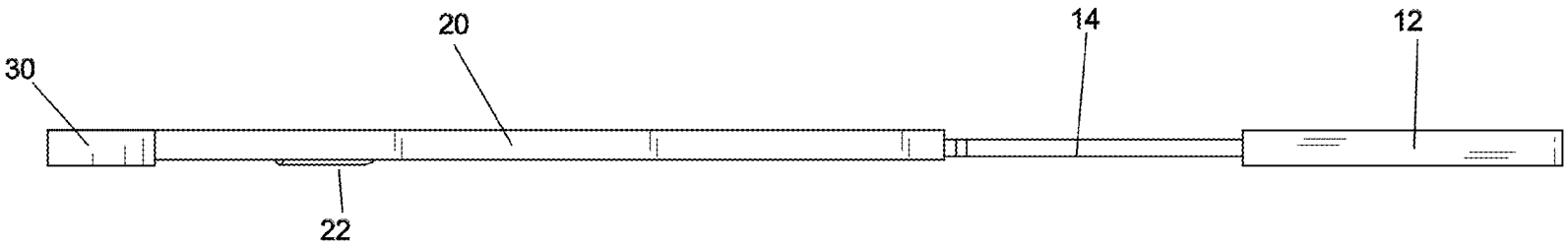
FIG. 4 shows a side view of a collar stay of an embodiment of the disclosed technology, turned 90 degrees with respect to FIG. 3.

FIG. 4 shows a side view of a collar stay of an embodiment of the disclosed technology, turned 90 degrees with respect to FIG. 3. Here, one can see the head 12, elongated portion 14, housing 20, protrusion 22, and back piece 30 which form the collar stay, as viewed from the outside.

Figure 5:
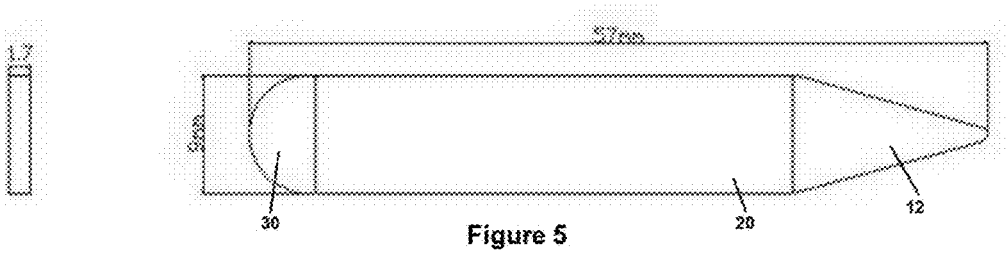
FIG. 5 shows a side plan view of a collar stay of an embodiment of the disclosed technology in a fully retracted configuration.
Figure 6:
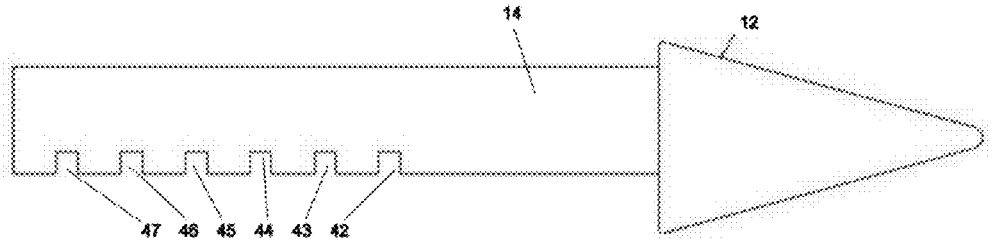
FIG. 6 shows a plan view of a toothed inner piece with outer head of an embodiment of the disclosed technology.
Figure 7:
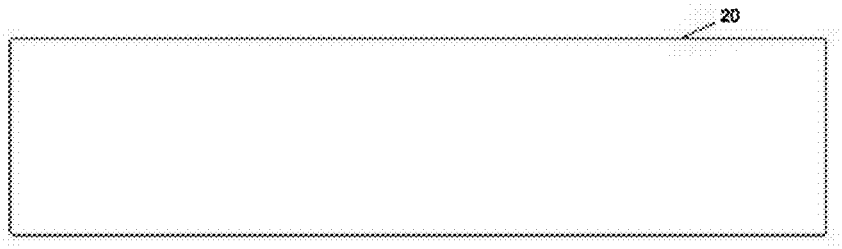
FIG. 7 shows a plan view of an outer housing of an embodiment of the disclosed technology.
Figure 8:
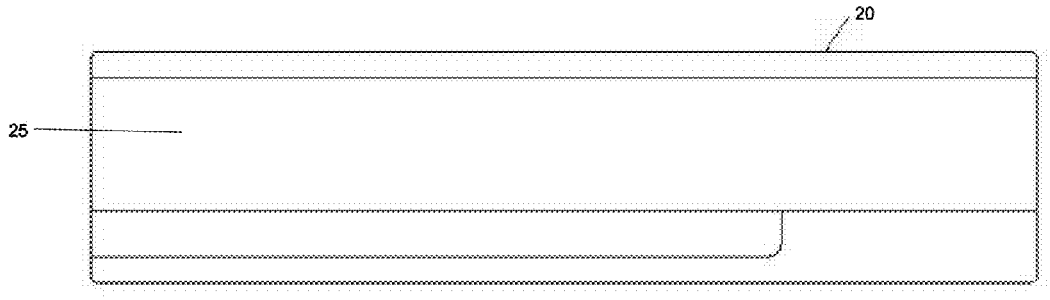
FIG. 8 shows a cutaway view of the outer housing of FIG. 7.

FIG. 5 shows a side plan view of a collar stay of an embodiment of the disclosed technology in a fully retracted configuration. FIG. 6 shows a plan view of a toothed inner piece with outer head of an embodiment of the disclosed technology. FIG. 7 shows a plan view of an outer housing of an embodiment of the disclosed technology. FIG. 8 shows a cutaway view of the outer housing of FIG. 7. These views are shown to give more perspective as to the dimensions of the elements of the device, relative to each other.

Figure 9:
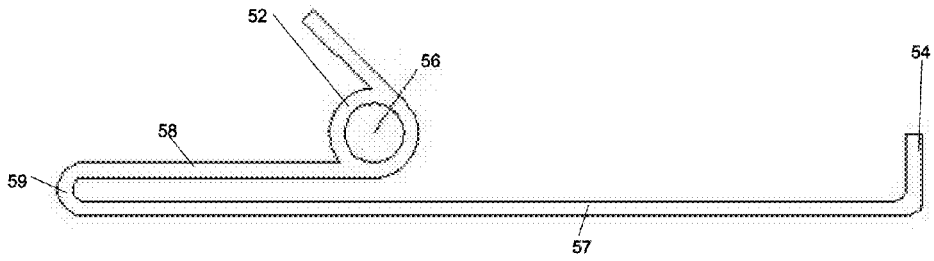
FIG. 9 shows a plan view of a spring used within the outer housing in an embodiment of the disclosed technology.

FIG. 9 shows a plan view of a spring used within the outer housing in an embodiment of the disclosed technology. The spring has a portal 56 adapted for surrounding and rotating on a flange 22 of the housing 20. In this manner, the spring is rotatably fixed to such a flange 22 at a first end of the spring-loaded pin 52. The spring then extends in a direction towards the back of the device into which it is placed, turns a sharp corner 59 and extends forward in a long region 57, past the portal 56 to a perpendicular or generally perpendicular (defined as between 70 and 110 degrees) second end 54. This second end 54 engages with any one of the plurality of pits on the elongated portion 14 of the movable piece 10.

Figure 10:
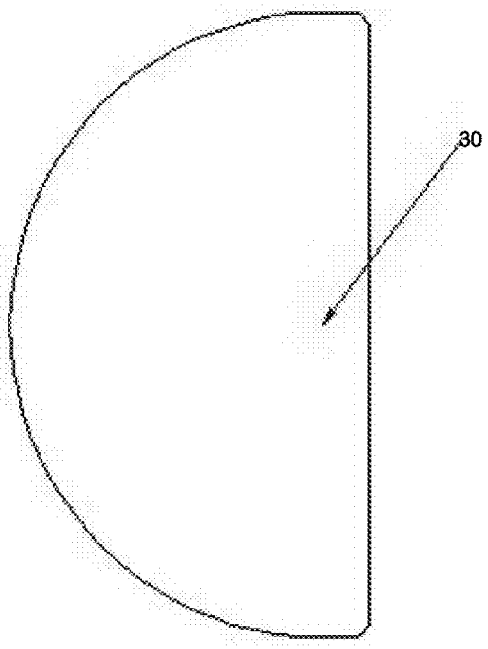
FIG. 10 shows a plan view of a back end piece of the adjustable collar stay used in an embodiment of the disclosed technology.

FIG. 10 shows a plan view of a back end piece of the adjustable collar stay used in an embodiment of the disclosed technology.

Referring now to the figures in general, and especially FIG. 2, the method of use is as follows. Starting in a partially extended configuration, one can see that the second end 54 of the pin 50 is engaged with the pit 48. However, the movable piece 10 is rotatably transverse to the elongated direction of the housing 20. That is, one can push the head 12 away from, or towards, the rotating second end 54 of pin 50, such that the elongated end portion 14 of the movable piece 10 becomes angled towards, or away from, the rotating second end 54 of pin 50. At the same time, the sides of the elongated portion 14, which in a resting state, are parallel to respective/corresponding three sides of the walls (back side, upper side, lower side, and, in addition, imaginary side, which is the opening of the portal) of the housing 20 surrounding the interior track 25, become offset from parallel. As such, when angling the rear of the elongated portion 14 (the 'rear' is the portion with the pits) away from the second end 54 of the pin 50, the movable piece 10 becomes slidable, with respect to the housing 20, as the pin 50 becomes disengaged from the pit 48 (or other pit). Now, one can slide the movable piece 10 in or out with respect to the housing 20, and release the head 12, such that the second end 54 of pin 50 engages with a different pit. One may move the movable piece 10, such that one or more pits pass the second end 54 of the pin 50, until being released, causing the second end 54 to enter any other pit. Further, as the pin is spring-loaded, the second end 54 tends to push against the elongated portion 14 of the movable piece, such that one can feel the tension as well as when a pit 'falls' (enters) into another pit. The potential energy, stored when pushing the head 12 ajar, becomes realized as kinetic energy when the pin latches onto another pit, causing a detectable vibration in the device, detectable to the human touch. Generally, one holds the head 12 in one hand, and housing 20 in another hand, and offsets one from the other by causing an acute angle between one and the other, allowing for the sliding of the two pieces, until the device is lengthened or shortened as desired.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. An adjustable collar stay, comprising:

an elongated housing with a hollow elongated interior space having a portal at one side forming a hollow interior track terminating at said portal;

a movable piece comprising a unitary head and elongated portion, said elongated portion adapted to slidably move within said hollow interior track of said elongated housing said unitary head, at a point of connection with said elongated portion, having a width greater than that of said elongated portion and of said hollow interior track of said housing, said greater width preventing movement of said unitary head into said hollow interior track;

wherein said unitary head of said movable piece is triangular, with a base thereof having said width greater than said hollow interior track, and a tip, opposite said base, having a width narrower than said hollow interior track;

a center of said base being offset with respect to said elongated portion, such that a portion of said base of said unitary head extending from said one of said two narrow sides divided by said pits is longer than a portion of said base of said unitary head extending from said other of said two narrow sides; and a spring-loaded pin, rotatably fixed at a first end thereof directly to said elongated housing and extending into a pit of said plurality of pits at a second end thereof.

2. The adjustable collar stay of claim 1, wherein, but for said spring-loaded pin extending into a pit of said plurality of pits, said movable piece is freely movable into and out of said portal at said front side.

3. The adjustable collar stay of claim 1, wherein, with said spring-loaded pin extending into a pit of said plurality of pits, said movable piece is movable in a direction transverse to said portal at said front side.

4. The adjustable collar stay of claim 3, wherein movement of said movable piece in said direction transverse to said portal at said front side dislodges said second end of said spring-loaded pin from a pit of said plurality of pits.

5. The adjustable collar stay of claim 4, wherein upon said dislodging of said spring-loaded pin from a said pit, said movable piece is slidable into and out of said portal at least until said second end of said spring-loaded pin engages with a different pit of said plurality of pits.

6. The adjustable collar stay of claim 5, wherein engagement of said second end of said spring-loaded pin engaging with a pit of said plurality of pits generates a kinetic force.

7. An adjustable length device, comprising: a housing with a hollow elongated interior; a pin rotatably fixed to a protrusion extending into said hollow elongated interior;

a slidable member adapted to slide within said hollow elongated interior in a manner such that said slidable member has a broad side parallel to at least one corresponding side of said hollow elongated interior in a resting position and a unitary head which is triangular, with a base thereof having said width greater than said hollow interior track, and a tip, opposite said base, having a width narrower than said hollow interior track, a center of said unitary head being offset with respect to said elongated portion such that a portion of said base of said unitary head extending from said one of said two narrow sides divided by said pits is longer than a portion of said base of said unitary head extending from said other of said two narrow sides; and a plurality of pits cut into one of said two narrow sides of said slidable member to divide said one of said two narrow sides into segments, each of said plurality of pits adapted to engage an end of said pin opposite a side of said pin fixed to said protrusion.

8. The adjustable length device of claim 7, wherein, in said resting position, when said pin is aligned with a pit of said plurality of pits, said pin rests within said pit.

9. The adjustable length device of claim 7, wherein, when said slidable member is offset by at least one degree from parallel to said at least one corresponding side of said hollow elongated interior of said housing, said pin is prevented from engaging with any pits of said plurality of pits.

10. The adjustable length device of claim 9, wherein said slidable member is freely slidable into and out of said housing when said slidable member is offset by at least one degree.

11. The adjustable length device of claim 7, said pin passing over a pit of said plurality of pits while sliding said slidable member generates a force.

12. The adjustable collar stay of claim 1, wherein said spring-loaded pin comprises: a portal forming part of said first end, which portal is rotatably fixed to a protrusion formed within said elongated housing, such that said spring-loaded pin is rotatable about the protrusion;

a spring portion forming a narrow U-shape, said elongated portion comprising:

an elongate rearward extending segment extending from said portal of said spring-loaded pin in a direction away from said portal of said elongated housing;

a corner segment in which said rearward extending segment turns a sharp corner; and an elongate forward extending segment extending from said corner segment in a direction towards said portal of said elongated housing, past said portal of said spring-loaded pin; and a second end, extending generally perpendicularly to said elongate forward extending segment and extending into said pit of said plurality of pits.

* * * * *